US009657432B2

(12) United States Patent
Bae et al.

(10) Patent No.: US 9,657,432 B2
(45) Date of Patent: May 23, 2017

(54) DRYING APPARATUS AND WASHING MACHINE HAVING THE SAME AND CONTROL METHOD THEREOF

(75) Inventors: Seok Keun Bae, Hwaseong-si (KR); Seong Min Oak, Hwanseong-si (KR); Phil Soo Chang, Seongnam-si (KR); Min Hee Kang, Suwon-si (KR); Hye Joon Seok, Incheon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 948 days.

(21) Appl. No.: 13/561,764

(22) Filed: Jul. 30, 2012

(65) Prior Publication Data

US 2013/0031798 A1 Feb. 7, 2013

(30) Foreign Application Priority Data

Aug. 1, 2011 (KR) ..... 10-2011-0076635
Nov. 11, 2011 (KR) ..... 10-2011-0117506

(51) Int. Cl.

| | |
|---|---|
| ***F26B 21/06*** | (2006.01) |
| ***F26B 7/00*** | (2006.01) |
| ***D06F 58/24*** | (2006.01) |
| ***D06F 58/28*** | (2006.01) |

(52) U.S. Cl.
CPC ..... *D06F 58/24* (2013.01); *D06F 58/28* (2013.01)

(58) Field of Classification Search
CPC ..... D06F 58/24; D06F 58/28; D06F 25/00
See application file for complete search history.

(56) References Cited

U.S. PATENT DOCUMENTS

2004/0000174 A1* 1/2004 Bolduan ..... D06F 17/04 68/5 D
2006/0090524 A1* 5/2006 Jeon ..... D06F 25/00 68/135
2006/0096114 A1* 5/2006 Hong ..... D06F 58/24 34/77

(Continued)

FOREIGN PATENT DOCUMENTS

DE 39 20 737 A1 1/1991
DE 102008008805 8/2008

(Continued)

OTHER PUBLICATIONS

European Search Report mailed Jun. 27, 2013 in corresponding European Application No. EP 12177652.0.

(Continued)

*Primary Examiner* — Michael Barr
*Assistant Examiner* — Benjamin L Osterhout
(74) *Attorney, Agent, or Firm* — Staas & Halsey LLP

(57) ABSTRACT

A drying apparatus having a structure capable of improving condensation efficiency, and a washing machine having the same. The washing machine including a cabinet, a tub installed inside the cabinet, a drum rotatably installed inside the tub, a condenser duct configured to condense moisture in air introduced from the inside the drum, a drying duct configured to heat the air introduced from the condenser duct and supply the heated air to the inside the drum, and a condensation water storage unit formed at a circumference of the condenser duct to store condensation water that is used to condense the moisture in the air moving inside the condenser duct.

7 Claims, 16 Drawing Sheets

(56) References Cited

U.S. PATENT DOCUMENTS

| | | | | |
|---|---|---|---|---|
| 2006/0179896 | A1* | 8/2006 | Lim | D06F 37/26 68/20 |
| 2007/0101602 | A1* | 5/2007 | Bae | D06F 58/206 34/77 |
| 2009/0211309 | A1* | 8/2009 | Kawabata | D06F 25/00 68/20 |
| 2010/0139111 | A1* | 6/2010 | Favret | D06F 58/24 34/76 |
| 2011/0041562 | A1 | 2/2011 | Balinski et al. | |

FOREIGN PATENT DOCUMENTS

| | | | |
|---|---|---|---|
| EP | 1612318 | | 1/2006 |
| EP | 1 852 539 | A1 | 11/2007 |
| EP | 2 108 730 | A1 | 10/2009 |
| EP | 2196126 | | 6/2010 |
| GB | 2181220 | | 4/1987 |
| KR | 2003-0084067 | | 11/2003 |
| KR | 10-2005-0054701 | | 6/2005 |
| KR | 10-2005-0099182 | | 10/2005 |
| KR | 10-2006-0004369 | | 1/2006 |
| KR | 10-2006-00322327 | | 4/2006 |
| KR | 10-2006-0082894 | | 7/2006 |

OTHER PUBLICATIONS

Partial European Search Report issued Dec. 13, 2012, in corresponding European Patent Application No. 12177652.0.

PCT International Search Report filed Jul. 31, 2012, issued in corresponding PCT Patent Application No. PCT/KR2012/006077.

* cited by examiner

DRYING APPARATUS AND WASHING MACHINE HAVING THE SAME AND CONTROL METHOD THEREOF

CROSS-REFERENCE TO RELATED APPLICATIONS

This application claims the priority benefit of Korean Patent Applications No. 10-2011-0076635, filed on Aug. 1, 2011, and No. 10-2011-0117506, filed on Nov. 11, 2011, the disclosures of which are incorporated by reference in its entirety for all purposes.

BACKGROUND

1. Field

Embodiments relate to a drum washing apparatus, and more particularly, a washing machine having a drying apparatus, and a control method thereof.

2. Description of the Related Art

In general, a drying apparatus of a washing machine performs a dry of a laundry by supplying air heated by a heating apparatus to an inside a drum to heat laundry, such that moisture is evaporated from the laundry and by discharging the moisture after condensing.

Such a drying apparatus is provided with a heat apparatus configured to supply hot air inside a drum, a heat duct which has one end connected to a discharge unit of a draft fan and another end communicating with an inside of the drum, and a condenser duct which has one end communicating with the inside the drum and another end connected to an induction unit of the draft fan to condense and discharge moist air in a process of guiding the moist air formed inside the drum toward the draft fan.

SUMMARY

Therefore, it is an aspect of the present disclosure to provide a washing machine having a drying apparatus which is configured to have an enhanced structure capable of improving condensation efficiency.

It is another aspect of the present disclosure to provide a control method of a washing machine capable of reducing condensation water used for a drying process of laundry.

Additional aspects of the disclosure will be set forth in part in the description which follows and, in part, will be apparent from the description, or may be learned by practice of the disclosure.

In accordance with one aspect of one or more embodiments, a washing machine includes a cabinet, a tub, a drum, a condenser duct, a drying duct and a condensation water storage unit. The tub is installed inside the cabinet. The drum is rotatably installed inside the tub. The condenser duct is configured to condense moisture in air introduced from the inside the drum. The drying duct is configured to heat the air introduced from the condenser duct and supply the heated air to the inside the drum. The condensation water storage unit is formed at a circumference of the condenser duct to store condensation water that is used to condense the moisture in the air moving inside the condenser duct.

The condensation water storage unit is formed at an outer side of the circumference of the condenser duct while forming a storage space to store condensation water in cooperation with an outer circumferential surface of the condenser duct.

The condensation water storage unit further includes a water supply nozzle configured to supply the condensation water. The water supply nozzle is provided at a lower portion of the condensation water storage unit.

The condenser duct further includes a communicating hole configured to communicate the condenser duct with the condensation water storage unit, wherein the condensation water stored in the condensation water storage unit is introduced into the inside the condenser duct through the communicating hole.

The communicating hole is provided at a upper position in relation to the water supply nozzle. The condensation water which is introduced through the water supply nozzle is moved to an upper portion of the condensation water storage unit to flow into the inside the condenser duct through the communicating hole and fall.

The condenser duct further includes a dispersion member that allows the condensation water introduced through the communicating hole to be dispersed inside the condenser duct and fall.

The dispersion member includes a dispersion board and a through hole. The dispersion board is provided at a lower portion of the communicating hole and extends from an inner circumferential surface of the condenser duct toward a central direction of the condenser duct. The through hole passes through the dispersion board to drop the condensation water positioned at an upper surface of the dispersion board.

The condensation water storage unit is formed at an inner side of the circumference of the condenser duct while forming a storage space to store condensation water in cooperation with an inner circumferential surface of the condenser duct.

The condensation water storage unit is provided in a form of surrounding the circumference of the condenser duct along at least one portion of the circumference of the condenser duct.

The condensation water storage unit includes a drain nozzle provided at a lower portion of the condensation water storage unit to drain the condensation water stored in the condensation water storage unit.

A condensation water drain valve configured to selectively open/close the drain nozzle is provided at the drain nozzle.

In accordance with another aspect of the present disclosure, a washing machine includes a cabinet, a tub, a condenser duct, a drying duct, a draft fan, a condensation water storage unit and a water supply nozzle. The tub is installed inside the cabinet. The condenser duct is configured to condense moisture in air introduced from the tub. The drying duct is configured to heat and dry air introduced from the condenser duct. The draft fan is positioned between the condenser duct and the drying duct to form a flow of air so that the air at the condenser duct is introduced inside the tub through the drying duct. The condensation water storage unit is provided at a certain section of the condenser duct to store condensation water that is used to condense the moisture in the air moving inside the condenser duct. The water supply nozzle is configured to supply the condensation water to the condensation water storage unit. The condensation water storage unit includes a housing and a heat exchange unit. The housing is configured to communicate with the condenser duct. The heat exchange unit is provided at an inner side of the housing to allow condensation water that is supplied to the housing to exchange heat with the air that is flowing inside the condenser duct.

The heat exchange unit is extended from a bottom surface of the housing lengthwise along the housing. The housing is divided into an inner side passage, which is connected to the condenser duct through the heat exchange unit and allows air to pass therethrough, and an outer side passage, which stores condensation water supplied from the water supply unit.

The condensation water storage unit further includes a communicating hole which is configured to communicate the inner side passage to the outer side passage. The condensation water stored in the outer side passage is introduced into the inner side passage through the communicating hole.

The washing machine further includes a water supply nozzle which is connected to the housing to supply the condensation water to the outer side passage. The water supply nozzle is provided at a lower position in relation to the communicating hole.

Condensation water stored after introduced into the outer side passage exchanges heat with air, which flows in the inner side passage, through the heat exchange unit to condense a moisture included in the air. Condensation water being moved to an upper portion of the outer side passage and introduced into the inner side passage through the communicating hole makes contact with air flowing through the inner side passage to condense a moisture in the air.

The condensation water storage unit further includes a dispersion member that allows the condensation water introduced through the communicating hole to be dispersed at the inner side passage and fall. The dispersion member includes a dispersion board which is extended from one end of the heat exchange unit toward a central direction of the housing, and a plurality of through holes which passes through the dispersion board to drop the condensation water positioned at an upper surface of the dispersion board.

In accordance with another aspect of the preset disclosure, a drying apparatus, which is used for a washing machine and provided on an outer surface of a tub of the washing machine to dry air inside the tub, includes a condenser duct and a drying duct. The condenser duct is configured to condense a moisture in air, which is introduced from the tub, while being communicated with the tub; and a drying duct configured to heat the air introduced from the condenser duct and to supply the air to the tub. The condenser duct includes an air passage and a condensation water passage. The air passage through which allows air to pass therethrough. The condensation water passage is provided at an outer side of the air passage to store condensation water used to condense a moisture in the air that flowing through the air passage.

The air passage and the condensation water passage communicate with each other such that the condensation water stored in the condensation water passage is introduced into the air passage.

In accordance with another aspect of the present disclosure, a washing machine includes a cabinet, a tub installed inside the cabinet, and a drying apparatus connected to the tub to circulate and dry air inside the tub. The drying apparatus includes a condenser duct and a drying duct. The condenser duct is provided with a first duct where air introduced from the tub flows, and with a second duct that stores condensation water supplied to condense a moisture in the air flowing through the first duct. The drying duct is configured to heat the air introduced from the first duct and supply the air heated to inside the drum.

In accordance with another aspect of the present disclosure, a control method of a drying stroke of a washing machine having a tub and a drying apparatus coupled to the tub to dry laundry by circulating air inside the tub is as follows. A weight of a laundry to be dried is measured. In a case when the weight of the laundry detected is below a predetermined value, a first drying course is applied to control an amount of condensation water supplied to the drying apparatus not to exceed a predetermined amount. A first drying stroke is conducted by operating the drying apparatus. In a case when the weight of the laundry detected is above the predetermined value, a second dry course is applied to control the condensation water to be supplied to the drying apparatus regardless of the predetermined amount. A second drying stroke is conducted by operating the drying apparatus.

The drying apparatus further includes a water supply nozzle allowing the condensation water to be introduced and a valve provided at the water supply nozzle.

The first drying stroke performs a process of adjusting the amount of the condensation water introduced into the drying apparatus by controlling the valve with ON/OFF functions.

The first drying stroke further includes a condensing stroke to condense the moisture in the air inside the drying apparatus and a heating stroke to heat the air inside the drying apparatus. The first drying course controls a frequency of the heating stroke to be increased while preventing the amount of the condensation water which is supplied to the drying apparatus from exceeding a predetermined amount.

The drying apparatus includes a condenser duct and a drying duct. The condenser duct is provided with a condensation water storage unit which is configured to communicate with the tub to condense the moisture in the air introduced from the tub. The drying duct is configured to heat the air introduced from the condenser duct and supply the heated air to the tub.

The first drying stroke or the second drying stroke includes measuring whether a predetermined time is elapsed after the first drying stroke or the second drying stroke is started, and supplying the condensation water to the condensation water storage unit in a case when the predetermined time is elapsed.

The first drying stroke or the second drying stroke includes measuring a temperature of the inside of the tub after the first drying stroke or the second drying stroke is started, and supplying the condensation water to the condensation water storage unit in a case when the temperature of the inside of the tub is higher than a predetermined temperature.

The first drying stroke or the second drying stroke includes measuring a temperature of air inside the drying duct after the first drying stroke or the second drying stroke is started. A process of supplying the condensation water to the condensation water storage unit is performed in a case when the temperature of the air inside the drying duct is higher than a predetermined temperature.

In accordance with another aspect of the present disclosure, a control method of a drying stroke of a washing machine including a tub and a drying apparatus coupled to the tub to dry laundry by circulating air inside the tub is provided. The drying apparatus includes a condenser duct provided with a condensation water storage unit configured to condense a moist in air introduced from the tub while being communicated with the tub; and a drying duct which is configured to heat the air introduced from the condenser duct and to supply the air to the tub. The drying stroke is as follows. It is measured whether a predetermined time is elapsed after the drying stroke is started. Condensation water is supplied to the condensation water storage unit in a case when the predetermined time is elapsed. Water is drained from the condensation water storage unit if it is determined that the drying of the laundry inside the tub is completed.

In accordance with another aspect of the present disclosure, a control method of a drying stroke of a washing machine including a tub and a drying apparatus coupled to the tub to dry laundry by circulating air inside the tub is provided. The drying apparatus includes a condenser duct provided with a condensation water storage unit configured to condense a moist in air introduced from the tub while being communicated with the tub; and a drying duct which is configured to heat the air introduced from the condenser duct and to supply the air to the tub. The drying stroke is as follows. A temperature inside the tub after the drying stroke is started is measured. Condensation water is supplied to the condensation water storage unit in a case when the temperature inside the tub is higher than a predetermined temperature. Water is drained from the condensation water storage unit if it is determined that the drying of the laundry inside the tub is completed.

In accordance with another aspect of the present disclosure, a control method of a drying stroke of a washing machine having a tub and a drying apparatus coupled to the tub to dry laundry by circulating air inside the tub is provided. The drying apparatus includes a condenser duct provided with a condensation water storage unit configured to condense a moist in air introduced from the tub while being communicated with the tub; and a drying duct which is configured to heat the air introduced from the condenser duct and to supply the air to the tub. The drying stroke is as follows. A temperature of air inside the drying duct after the drying stroke is started is measured. Condensation water is supplied to the condensation water storage unit in a case when the temperature of the air inside the drying duct is higher than a predetermined temperature. Water is drained from the condensation water storage unit if it is determined that the drying of the laundry inside the tub is completed.

The condensation water is intermittently supplied to the condensation water storage unit.

According to an embodiment of the present disclosure, since the condensation efficiency of a drying apparatus is improved, the time to dry laundry is shortened and power consumption is reduced.

BRIEF DESCRIPTION OF THE DRAWINGS

These and/or other aspects of one or more embodiments will become apparent and more readily appreciated from the following description of embodiments, taken in conjunction with the accompanying drawings of which.

DETAILED DESCRIPTION

Figure 1:
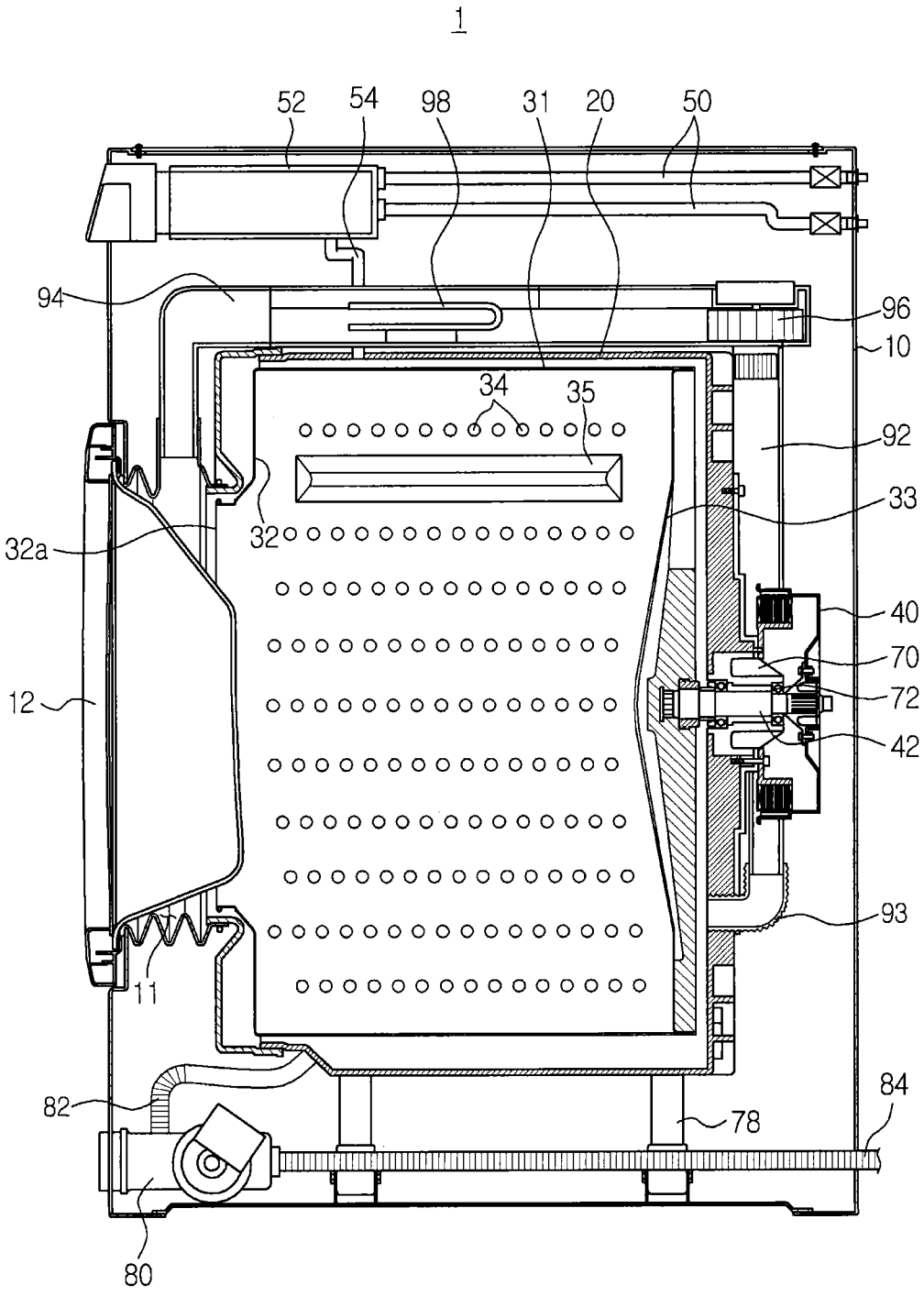
FIG. 1 is a view illustrating a washing machine according to an embodiment of the present disclosure.

Reference will now be made in detail to embodiments of the present disclosure, examples of which are illustrated in the accompanying drawings, wherein like reference numerals refer to like elements throughout.

Figure 2:
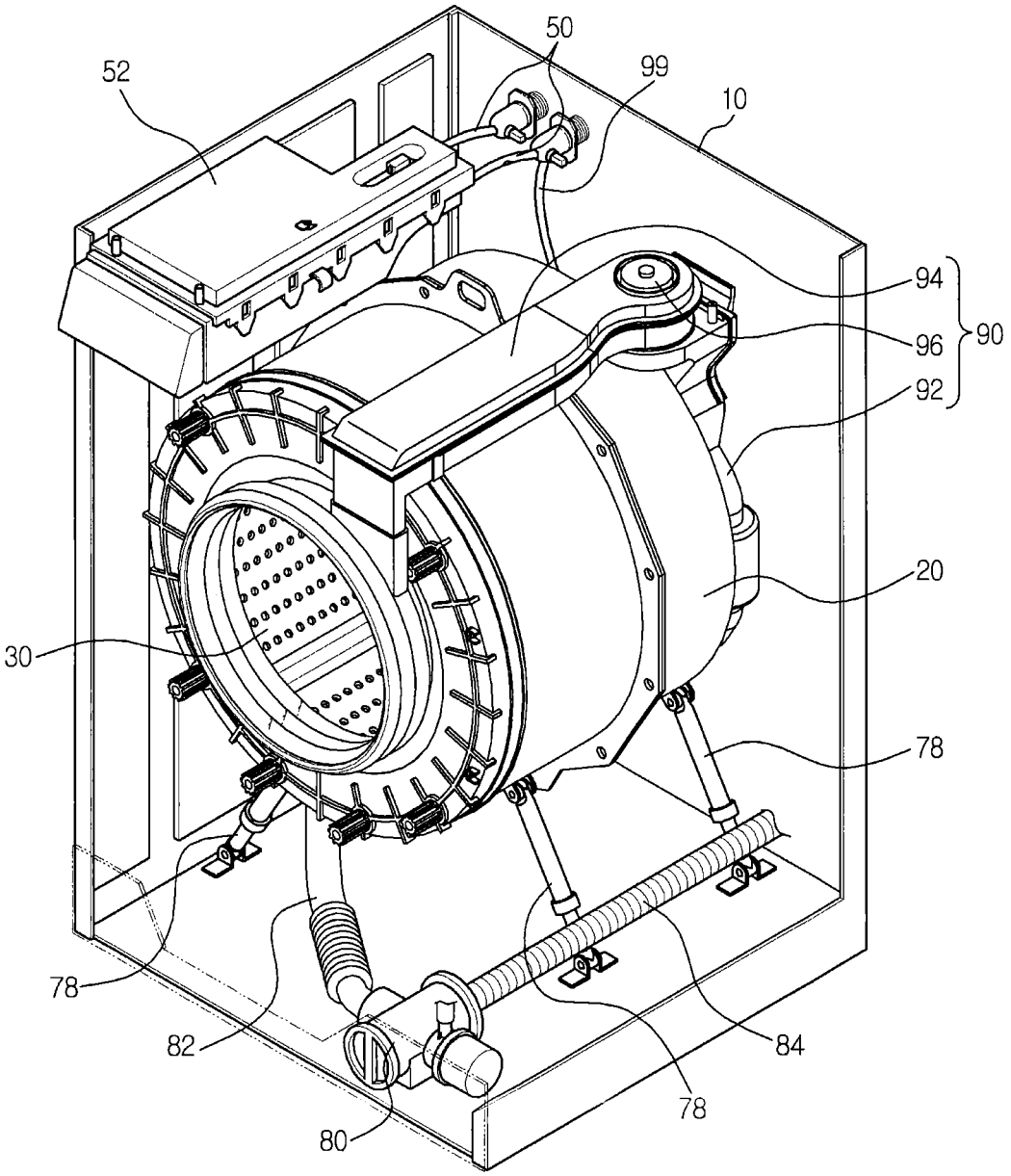
FIG. 2 is a perspective view illustrating a part of FIG. 1.
Figure 3:
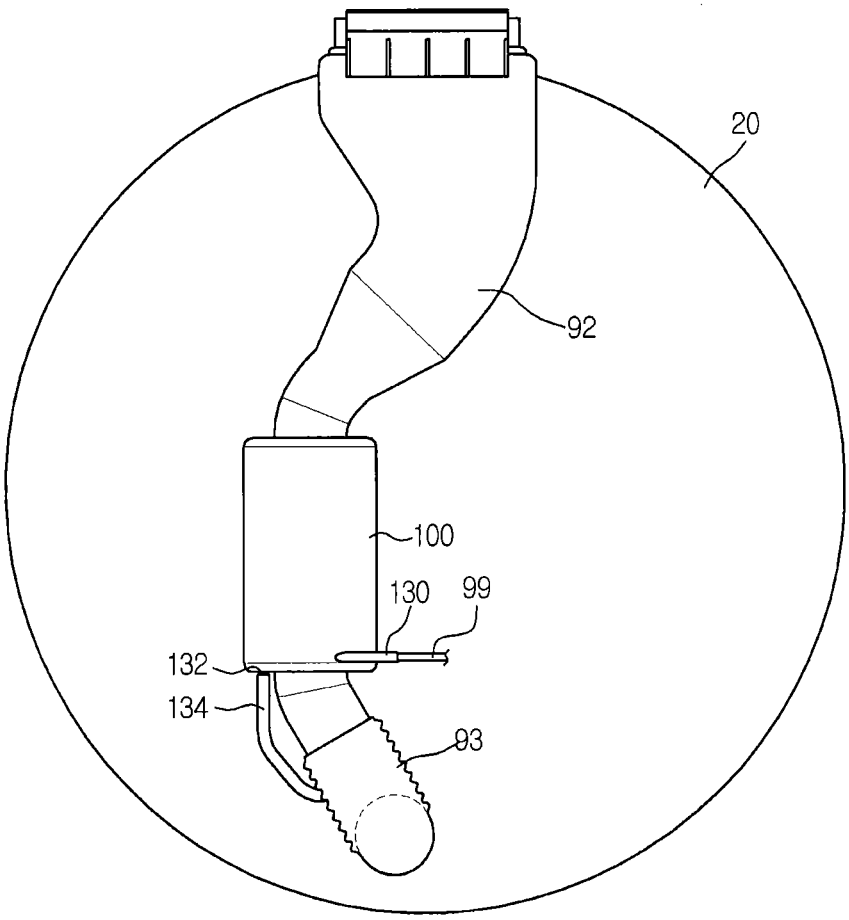
FIG. 3 is a rear side view illustrating a tub and a condenser duct of FIG. 2.

FIG. 1 is a view illustrating a washing machine according to an embodiment of the present disclosure. FIG. 2 is a perspective view illustrating a part of FIG. 1. FIG. 3 is a rear side view illustrating a tub and a condenser duct of FIG. 2.

Referring to FIGS. 1 to 3, a washing machine 1 is provided with a cabinet 10 which forms an exterior of the washing machine 1, a tub 20 disposed inside the cabinet 10, a drum 30 which is rotatably installed in the tub 20, and a motor 40 which operates the drum 30.

An inlet 11 is formed at a front side of the cabinet 10 to input laundry to the inside of the drum 30. The inlet 11 is open/closed by a door 12 installed at the front side of the cabinet 10.

A water supply pipe 50 is installed at the upper portion of the tub 20 to supply washing water to the tub 20. One side of the water supply pipe 50 is connected to an outside water supply source (not shown) and the other side of the water supply pipe 50 is connected to a detergent supply unit 52.

The detergent supply unit 52 is connected to the tub 20 through a connecting pipe 54. The water supplied through the water supply pipe 50 is supplied, via the detergent supply unit 52 and along with detergent, to the inside of the tub 20.

The tub 20 is supported by a plurality of dampers 78. The plurality of dampers 78 is configured to connect a bottom surface of the inside of the cabinet 10 to an outer surface of the tub 20.

The drum 30 includes a cylindrical unit 31, a front surface board 32 disposed on a front of the cylindrical unit 31, and a rear surface board 33 disposed on a rear of the cylindrical unit 31. An opening 32*a* is formed through the front surface board 32, and a drive shaft 42 which is configured to provide power to the motor 40 is connected to the rear surface board 33.

A plurality of holes 34 is formed around the circumference of the drum 30, and a plurality of lifters 35 is installed at an inner circumferential surface of the drum 30 to enable the rise and fall of laundry when the drum 30 rotates.

The driving shaft 42 is disposed between the drum 30 and the motor 40. One end of the driving shaft 42 is connected to the rear surface board 33 of the drum 30, and the other end is extended to the outside the a rear wall of the tub 20. When the motor 40 operates the driving shaft 42, the drum 30 connected to the driving shaft 42 is rotated on the driving shaft 42.

A bearing housing 70 is installed at the rear wall of the tub 20 to rotatably support the driving shaft 42. The bearing housing 70 may include aluminum alloy, and may be inserted into the rear wall of the tub 20 when the tub 20 is formed through an injection molding. Bearings 72 are installed between the bearing housing 70 and the driving shaft 42 for the driving shaft 42 to rotate smoothly.

A draining pump 80, a connecting hose 82 and a draining hose 84 are provided at a bottom portion of the tub 20. The draining pump 80 is configured to drain the water inside the tub 20 to outside the cabinet 10. The connecting hose 82 is configured to connect the tub 20 to the draining pump 80 for the water inside the tub 20 to be introduced into the draining pump 80. The draining hose 84 is configured to guide the water pumped by the draining pump 80 to outside are provided at a bottom portion of the tub 20.

A drying apparatus 90 is installed at the tub 20 to dry the air inside the tub 20 and supply again to the inside the tub 20.

The drying apparatus 90 includes a condenser duct 92 which is configured to condense the moisture in the air introduced from the tub 20, a drying duct 94 which is configured to dry the air introduced from the condenser duct 92 using heat, and a draft fan 96 which is arranged between the condenser duct 92 and the drying duct 94 to form a flow of air so that the air introduced into the condenser duct 92 may be flowed in to the inside the tub 20 through the drying duct 94. A heater 98 is placed at the drying duct 94 for heating the air inside the drying duct 94, and a condensation water storage unit (100 in FIG. 3) is formed at the condenser duct 92 for storing the condensation water to condense the moisture in the air inside the condenser duct 92.

Figure 4:
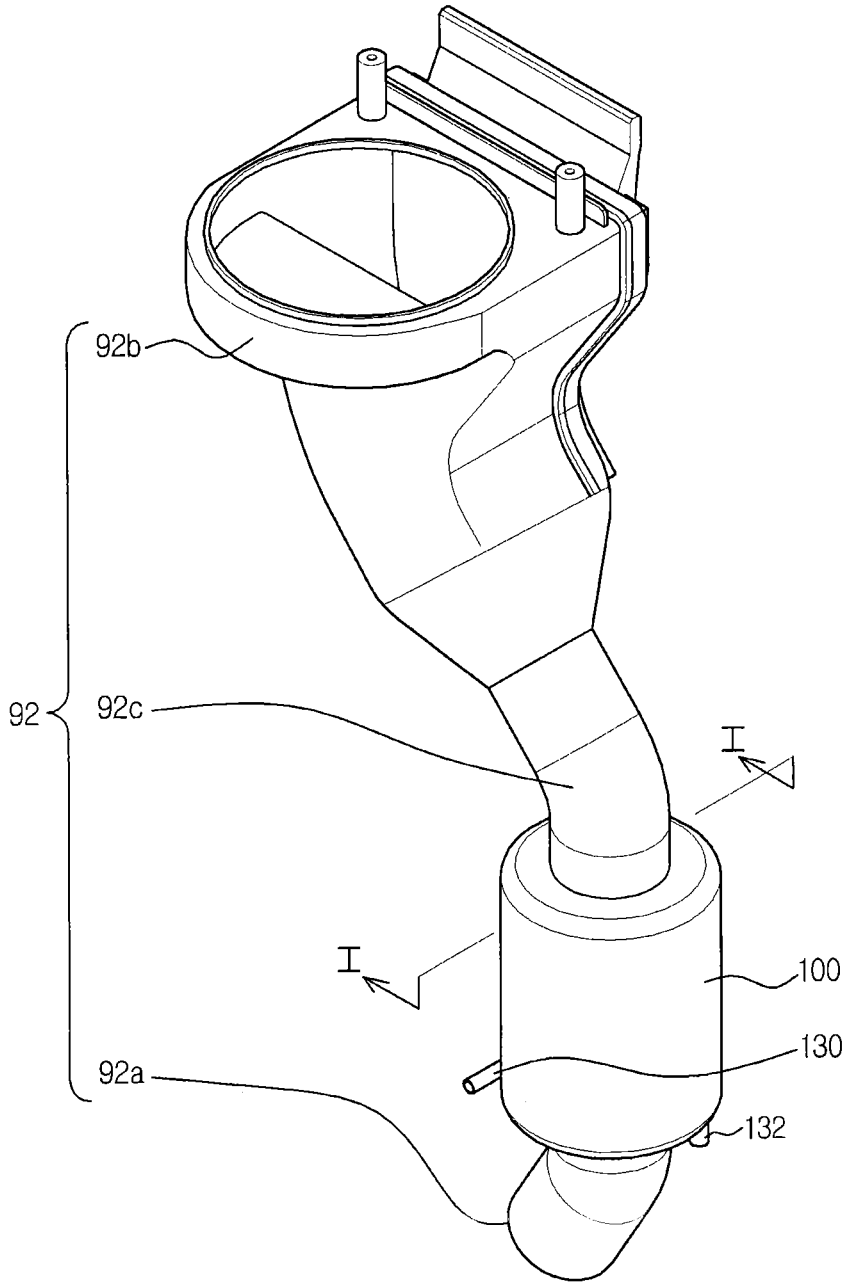
FIG. 4 is a perspective view illustrating a condenser duct according to a first embodiment of the present disclosure.
Figure 5:
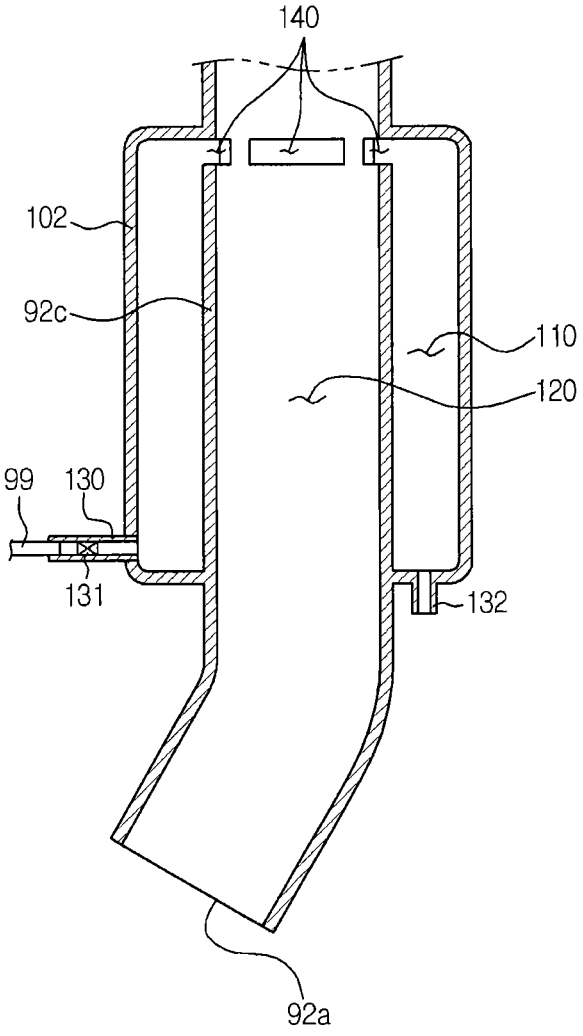
FIG. 5 is a cross-sectional view taken along line I-I of FIG. 4.
Figure 6:
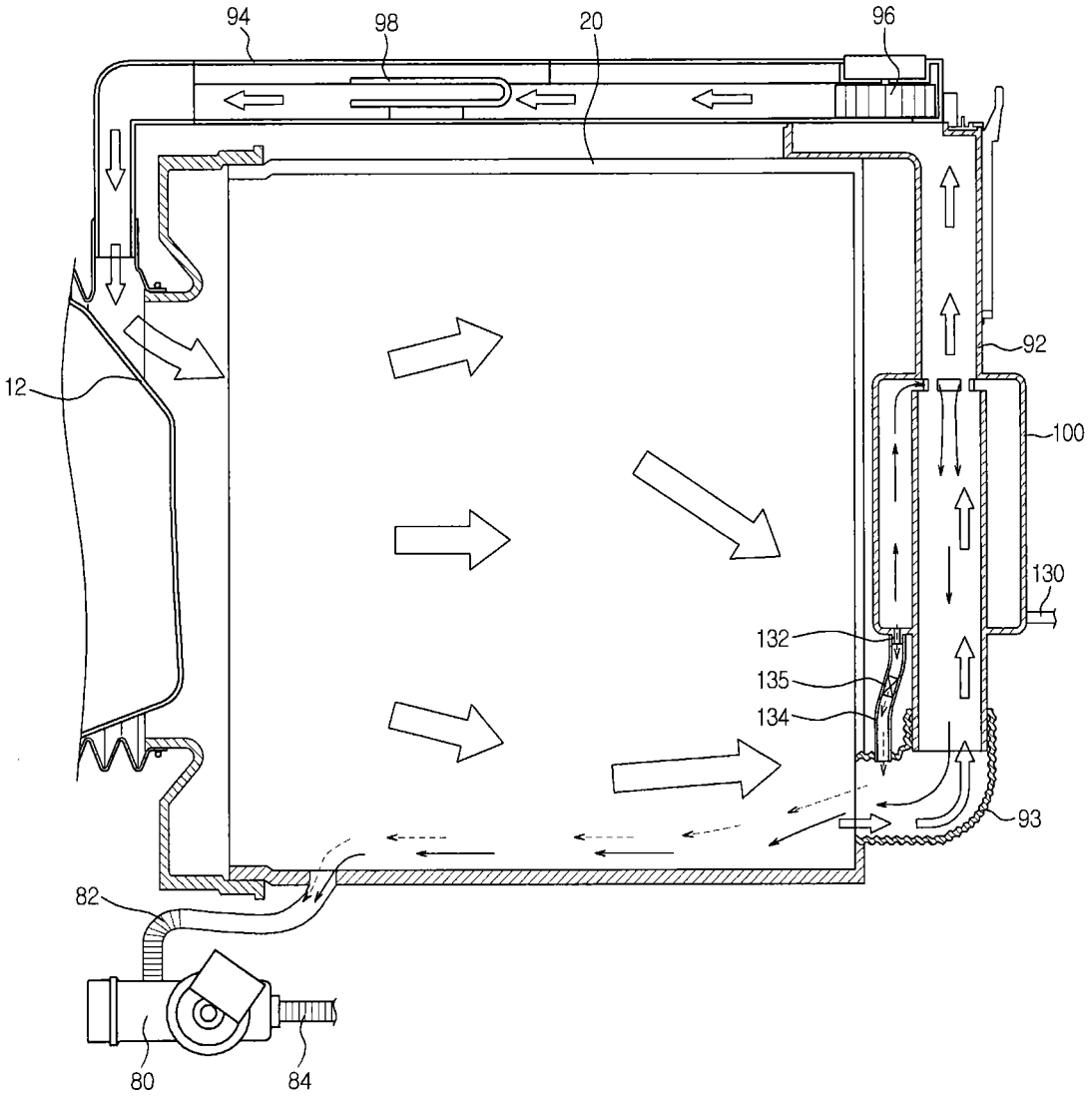
FIG. 6 is a view illustrating a route of condensation water or the water condensed by the condensation water being discharged.

FIG. 4 is a perspective view illustrating a condenser duct 92 according to a first embodiment of the present disclosure. FIG. 5 is a cross-sectional view taken along line I-I of FIG. 4. FIG. 6 is a view illustrating a route of condensation water or the water condensed by the condensation water being discharged. The "condensation water" hereafter refers to the water supplied to condense the moisture in the air flowing inside the condenser duct 92.

Referring to FIGS. 3 to 6, the condenser duct 92 is provided at both ends with an intake port 92*a* and a draft fan installing unit 92*b*, respectively and provided with a connecting pipe 92*c* which connects the intake port 92*a* to the draft fan installing unit 92*b*. The intake port 92*a* allows air inside the tub 20 to be introduced therethrough. The draft fan installing unit 92*b* is configured to install the draft fan 96 thereon.

The intake port 92*a* is connected to the rear wall of the tub 20 through a duct connecting hose 93 such that air inside the tub 20 is introduced to the connecting pipe 92*c*. Although not shown, the intake port 92*a* may be configured to be directly connected to the rear wall of the tub 20. The draft fan 96 is installed at the draft fan installing unit 92*b* to form a flow of air so that the air introduced into the connecting pipe 92*c* flows to the drying duct 94. An air passage 120 is formed at the inner side of the connecting pipe 92*c* so that the air introduced from the intake port 92*a* may flow to the draft fan installing unit 92*b*.

The condensation water storage unit 100 is provided at the outer side of the circumference of the connecting pipe 92*c* to store the condensation water in cooperation with the outer circumferential surface of the connecting pipe 92*c*.

The condensation water storage unit 100 includes a housing 102 provided in the form of surrounding the connecting pipe 92*c* at the outer side of the circumference of the connecting pipe 92*c*, a water supply nozzle 130 provided at one side of the housing 102 to supply the condensation water to the inside the housing 102, and a drain nozzle 132 configured to drain the remaining water at the condensation water storage unit 100 after a drying process is completed. A valve 131 which is configured to shut off/release the condensation water flowed in to the condensation water passage 110 from the water supply nozzle 130 may be provided at the water supply nozzle 130 of the drying apparatus 90.

The housing 102 forms a storage space 110 to store the condensation water in cooperation with the outer circumferential surface of the connecting pipe 92*c* by sealing a certain section of the outer circumferential surface of the connecting pipe 92*c*. Since the condensation water which is introduced into the storage space 110 through the water supply nozzle 130 moves to the upper side of the storage space 110, the storage space 110 may be referred to as a condensation water passage.

The water supply nozzle 130 is provided at one side of the bottom portion of the housing 102, and a water supply pipe (99, refer to FIG. 2) is connected to one end of the water supply nozzle 130 such that the condensation water is supplied to the storage space 110 through the water supply nozzle 130.

The reason that the water supply nozzle 130 is provided at the bottom portion of the housing 102 is to entirely introduce the condensation water introduced into the storage space 110 through the water supply nozzle 130, into the air passage 120 through a communicating hole 140 instead of leaving inside of the storage space 110. The condensation water introduced into the storage space 110 through the water supply nozzle 130 moves to an upper side of the storage space 110 by a water pressure acting in a direction of pushing the condensation water upward. In this process, the condensation water exchanges heat with the air, which flows in the air passage 120, through the connecting pipe 92*c* to condense a moisture in the air. In a case when the condensation water introduced into the storage space 110 is positioned at a lower portion than the water supply nozzle 130 is, the water pressure does not serve to push the condense upward, and therefore, the condensation water fails to move to the upper portion of the storage space 110 and is congested. Since the congested condensation water positioned at a lower portion than the water supply nozzle 130, as time goes by, may not be able to serve to condense the moisture in the air flowing at the air passage 120, thereby resulting in lower condensation efficiency of the condenser duct. Therefore, in order to minimize the amount of the condensation water positioned at a lower portion than the water supply nozzle 130, the water supply nozzle 130 may be positioned at the lowest portion of the housing 102.

The drain nozzle 132 is extended from the bottom portion of the housing 102 by a predetermined length. One end of the drain nozzle 132 is coupled to a condensation water drain hose 134 which connects the drain nozzle 132 to the duct connecting hose 93 such that the drain nozzle 132 and the duct connecting hose 93 communicate with each other. Although not shown, the condensation water drain hose 134 may be configured to be directly connected to the rear wall of the tub 20 instead of being connected to the duct connecting hose 93.

After the drying process is completed, the remaining condensation water (hereafter called "the remaining water") at the condensation water storage unit 100, that is, the remaining water which is not fallen inside the connecting pipe 92*c* through the communicating hole 140, is introduced into the duct connecting hose 93 through the condensation water drain hose 134, which is coupled to the drain nozzle 132 provided at the bottom portion of the housing 102, and the condensation water drain hose 134 coupled to one end of the drain nozzle 132. The remaining water introduced into the duct connecting hose 93 sequentially moves to inside the tub 20, and the draining pump 80 through the connecting hose 82 which is connected to the bottom portion of the tub 20, and then is discharged to outside the cabinet 10 in a way of being pumped by the draining pump 80 or through a natural draining process.

A condensation water draining valve 135 may be provided at the draining nozzle 132 or at the condensation water draining hose 134 to selectively drain the remaining water at the condensation water storage unit 100. The condensation water draining valve 135, in a process of condensing the moisture in the air introduced into the condenser duct 92, closes the draining nozzle 132 or the condensation water draining hose 134, in order to prevent the condensation water, which is introduced into the condensation water storage unit 100 through the water supply nozzle 130, from being drained through the draining nozzle 132 or the condensation water draining hose 134. If the process of condensing the moisture in the air introduced into the condenser duct 92 or the drying process is completed, the condensation water draining valve 135 is open to allow the remaining water at the condensation water storage unit 100 to introduced into the duct connecting hose 93. As for such condensation water draining valve 135 may be implemented using a mechanical open/close value or an electronic open/close value.

The communicating hole 140 which is configured to communicate the storage space 110 to the air passage 120 is formed at the connecting pipe 92*c*.

The communicating hole 140 passes through the connecting pipe 92*c* while being formed around the circumference of and in a circumferential direction of the connecting pipe 92*c* in a predetermined length.

In addition, the communicating hole 140 is disposed at an upper portion than the water supply nozzle 130 so that the condensation water introduced into the storage space 110 through the water supply nozzle 130 may move to an upper portion of the storage space 110 and be introduced into the air passage 120.

The condensation water introduced into the storage space 110 through the water supply nozzle 130 after moving to an upper portion of the storage space 110, is introduced into the air passage 120 through the communicating hole 140, and falls.

The condensation water exchanges heat with air moving through the air passage 120 to condense the moisture in the air in a process of moving to an upper portion or in a process of being stored at the storage space 110. In addition, the condensation water condenses the moisture in the air by directly making contact with the air in a process of falling after being introduced into the air passage 120.

The condenser duct 92 and the condensation water storage unit 100 may be integrally formed through a manufacturing method such as an injection molding, etc.

The high-temperature and high-moisture air which has absorbed the moisture contained in the laundry inside the drum 30 is introduced into the condenser duct 92 which is connected to the tub 20. The moisture in the air which is introduced into the condenser duct 92 is condensed by exchanging heat with the condensation water stored in the condensation water storage unit 100 while passing through the condensation water storage unit 100, or is condensed by the condensation water flowing inside the condenser duct 92 after being spilled over from the condensation water storage unit 100, and is fallen to the bottom portion of the condenser duct 92, and then sequentially passing through the duct connecting hose 93, the tub 20, the connecting hose 82, the draining pump 80, and the draining hose 84 to be discharged to the outside the washing machine 1.

The air that passes through the condenser duct 92 is introduced into the drying duct 94 through the draft fan 96 in a state that most of the moisture is eliminated. The air introduced into the drying duct 94 is heated by the heater 98 inside the drying duct 94, and the heated air having a high temperature and a dry state is introduced into the inside the tub 20. The reason for having the heater 98 inside the drying duct 94 and heating the air is because the amount of moisture to be absorbed by air increases as the temperature of the air increases, and therefore, the moisture contained in the laundry may be effectively absorbed.

The high-temperature, dry air introduced into the inside the tub 20 absorbs the moisture contained in the laundry inside the drum 30 and then is introduced into the condenser duct 92; and by repeating such process the laundry is dried by eliminating the moisture contained in the laundry.

Meanwhile, as shown in FIG. 6, the condensation water fallen inside the condenser duct 92 after being spilled over the condensation water storage unit 100, together with water condensed from moisture in the air flowing inside the drying duct 92 sequentially passes through the duct connecting hose 93, the tub 20, the connecting hose 82, the draining pump 80, and the draining hose 84, and is being discharged to the outside the washing machine 1.

In addition, as already described above, after the drying process is completed, the remaining water at the condensation water storage unit 100 sequentially passes through the draining nozzle 132, the condensation water draining hose 134, the duct connecting hose 93, the tub 20, the connecting hose 82, the draining pump 80, and the draining hose 84, and is being discharged to the outside the washing machine 1.

Figure 7:
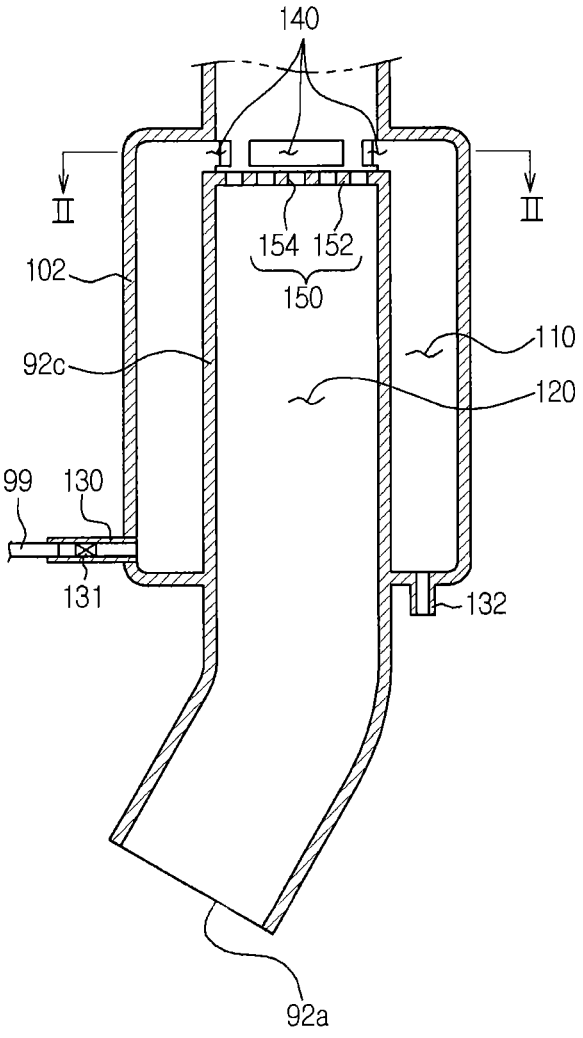
FIG. 7 is a cross-sectional view illustrating a condenser duct according to a second embodiment of the present disclosure.
Figure 8:
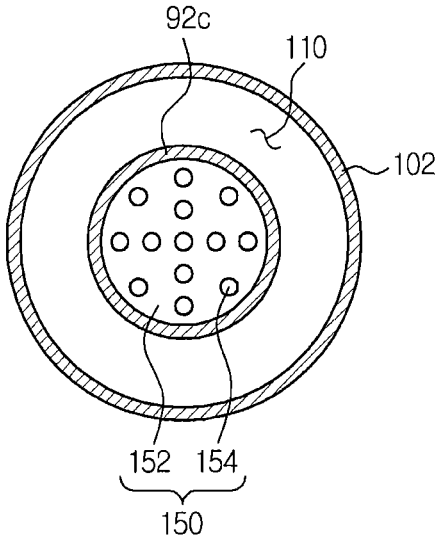
FIG. 8 is a cross-sectional view following an II-II line on FIG. 7.

FIG. 7 is a cross-sectional view illustrating a condenser duct according to a second embodiment of the present disclosure. FIG. 8 is a cross-sectional view following an II-II line on FIG. 7.

Referring to FIGS. 7 and 8, the condenser duct 92 may further include a dispersion member 150 so that the condensation water introduced into the air passage 120 may be dispersed and fall.

The dispersion member 150 is positioned at the bottom portion of the communicating hole 140, and includes a dispersion board 152 which is extendedly formed from an inner circumferential surface toward a central direction of the connecting pipe 92*c* and a through hole 154 which passes through the dispersion board 152.

The condensation water, which is fallen to the upper surface of the dispersion board 152 through the communicating hole 140, is dispersed toward a direction of the intake port 92*a* through the through hole 154 and falls. Therefore, since the contact surface between the air flowing in the air passage 120 and the condensation water becomes larger, the condensation efficiency improves further.

Figure 9:
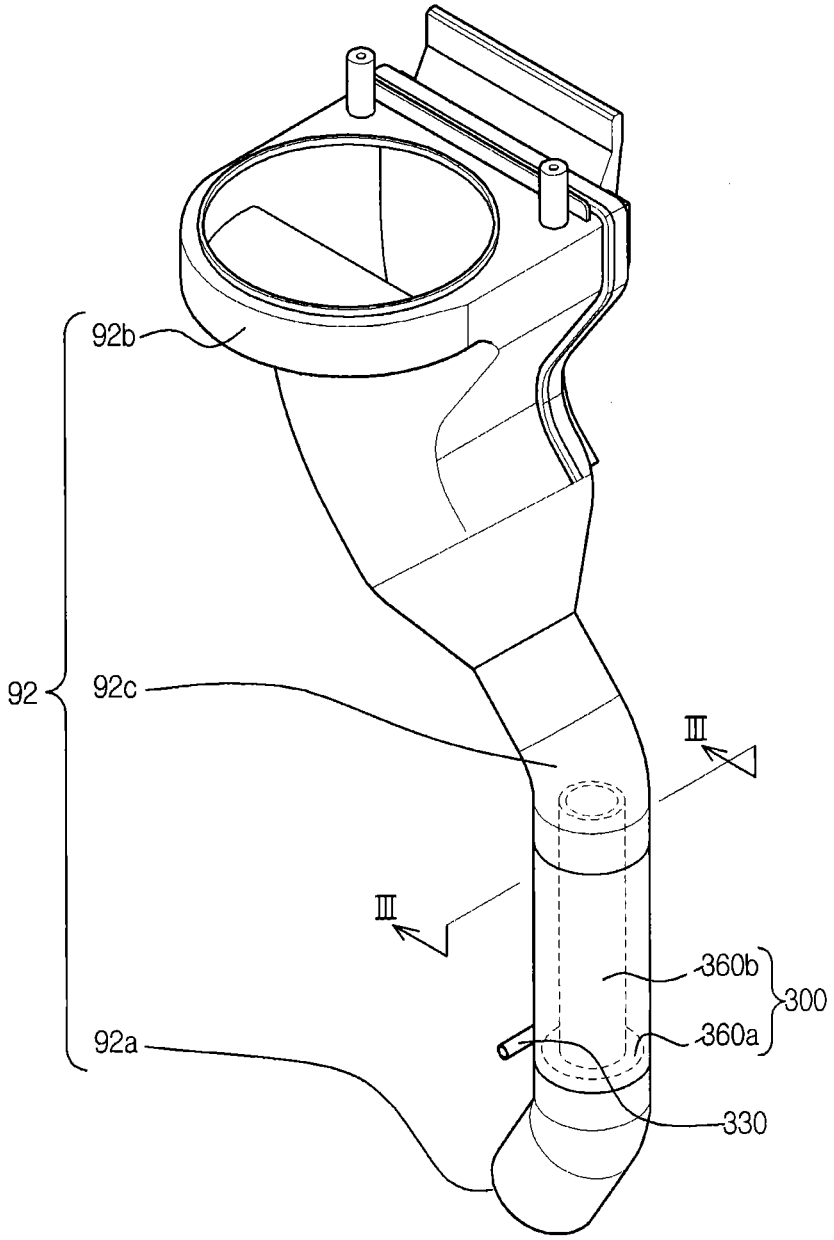
FIG. 9 is a perspective view illustrating a condenser duct according to a third embodiment of the present disclosure.
Figure 10:
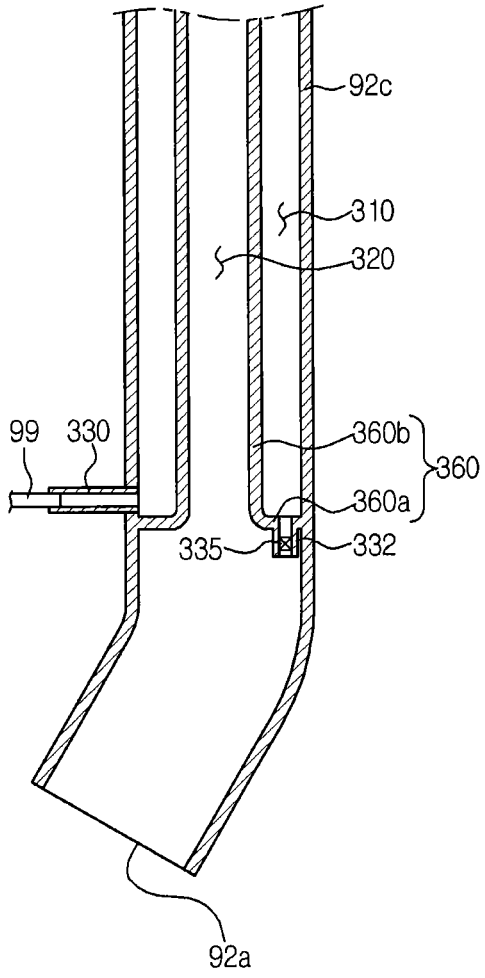
FIG. 10 is a cross-sectional view taken along line III-III of FIG. 9.

FIG. 9 is a perspective view illustrating a condenser duct according to a third embodiment of the present disclosure. FIG. 10 is a cross-sectional view taken along line III-Ill of FIG. 9.

Referring to FIGS. 9 and 10, a condensation water storage unit 300 is provided on an inner side of the circumference of the connecting pipe 92*c* to store the condensation water supplied from a water supply nozzle 330 in cooperation with the inner circumferential surface of the connecting pipe 92*c*.

The condensation water storage unit 300 includes a bottom surface 360*a* which is extended from the inner circumferential surface of the connecting pipe 92*c* toward a central direction of the connecting pipe 92*c* to form a bottom portion of the condensation water storage unit 300, and a partition surface 360*b* which is extended from the bottom surface 360*a* to the upper portion and partitions an interior of the connecting pipe 92*c*.

The bottom surface 360*a* and the partition surface 360*b*, along with the inner circumferential surface of the connecting pipe 92*c*, form a storage space 310 in which the condensation water is stored. The condensation water, which is flowed into the storage space 310 through the water supply nozzle 330, moves to the upper portion of the storage space 310, and therefore, the storage space 310 may be referred to as a condensation water passage.

The water supply nozzle 330, by penetrating through the connection pipe 92*c*, communicates with one side of the bottom portion of the storage space 310, and the water supply pipe (99 in FIG. 2) is connected to an end portion of the water supply nozzle 330 to supply the condensation water to the storage space 310 through the water supply nozzle 330.

The reason that the water supply nozzle 330 is configured to communicate with the bottom portion of the storage space 310 is same as the reason, as previously described, that the water supply nozzle 130 is provided at the bottom portion of the housing 102 at the condenser duct 92 according to the first embodiment of the present disclosure, and thus the detailed description thereof will be omitted.

A draining nozzle 332, by penetrating through the connection pipe 92*c*, communicates with other side of the bottom portion of the storage space 310, and the condensation water drain hose 134, which connects the draining nozzle 332 to the duct connecting hose 93, is coupled to the end portion of the draining nozzle 332 so that the draining nozzle 332 may communicates with the duct connecting hose 93. Although not shown, the condensation water drain hose 134 may be configured to be directly connected to the rear wall of the tub 20 without being connected to the duct connecting hose 93.

Since the process of the remaining condensation water at the condensation water storage unit 300 discharged to the outside the cabinet 10 after the drying process is completed is same as the case of the first embodiment of the present disclosure described above, the explanation will be omitted.

A condensation water draining valve 335 which is configured to selectively drain the remaining water at the condensation water storage unit 300 may be provided at the draining nozzle 332. The condensation water draining valve 335, in a process of condensing the moisture in the air flowed into the condenser duct 92, closes the draining nozzle 332, in order to prevent the condensation water, which is flowed into the condensation water storage unit 300 through the water supply nozzle 330, from being drained through the draining nozzle 332; and if the process of condensing the moisture in the air flowed in to the drying duct 92 or the drying process is completed, allows the remaining water at the condensation water storage unit 300 to be discharged. As for such condensation water draining valve 335, both a mechanical and an electronic open/close value may be used.

The condensation water flowed in to the storage space 310 through the water supply nozzle 330 moves to the upper portion of the storage space 310, and is flowed in to the air passage 320 through an opening formed between the inner circumferential surface of the connecting pipe 92*c* and the partition surface 160*b* and falls.

The condensation water, in a process of moving to an upper portion or in a process of being stored at the storage space 310, exchanges heat with the air moving through the air passage to condense the moisture in the air, and condenses the moisture in the air by directly making contact with the air in a process of falling after being flowed in to the air passage 320.

Meanwhile, the condenser duct 92 and the condensation water storage unit 300 may be integrally formed through a manufacturing method such as an injection molding, etc.

Although not shown, the condensation water storage unit 300, in order to increase the condensation efficiency, may include the dispersion member 150 so that the condensation water flowed in through the air passage 320 may be dispersed and fall.

Figure 11:
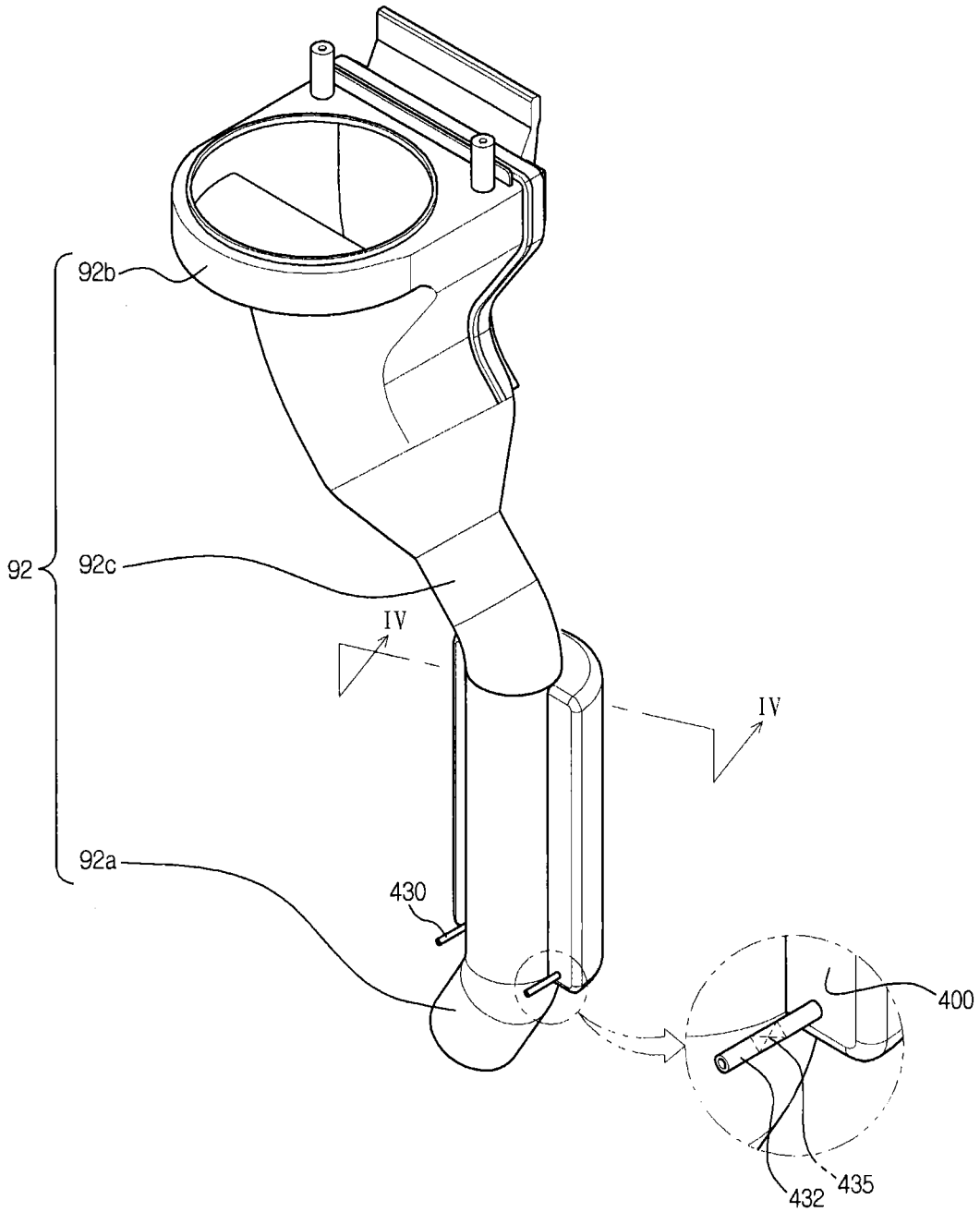
FIG. 11 is a perspective view illustrating a condenser duct according to a fourth embodiment of the present disclosure.
Figure 12:
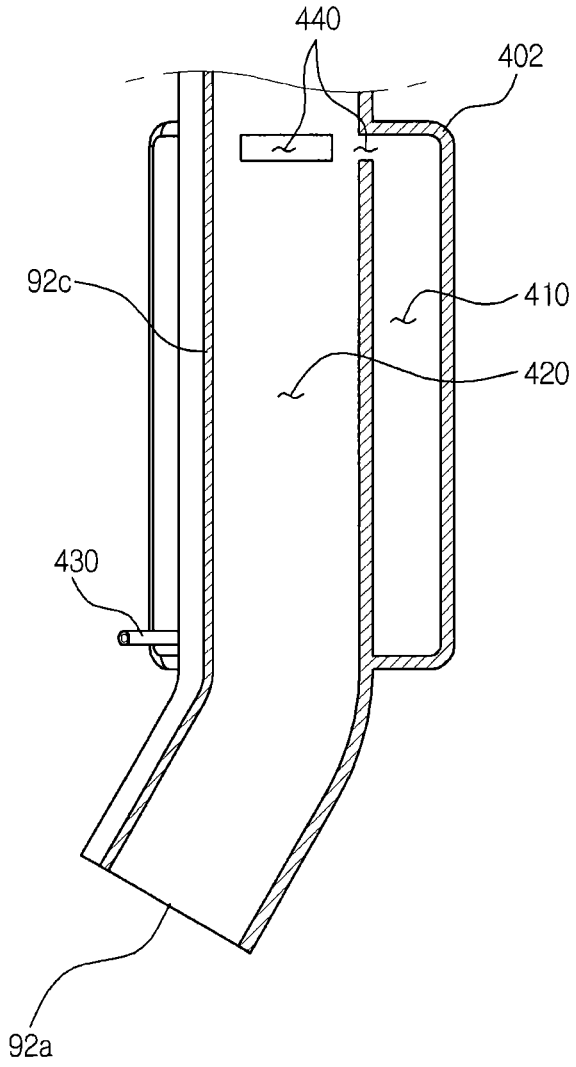
FIG. 12 is a cross-sectional view taken along line IV-IV of FIG. 11.

FIG. 11 is a perspective view illustrating a condenser duct according to a fourth embodiment of the present disclosure. FIG. 12 is a cross-sectional view taken along line IV-IV of FIG. 11.

Referring to FIGS. 11 and 12, the condensation water storage unit 400 is provided on at least one portion of the circumference of the connecting pipe 92*c* to store the condensation water in cooperation with the outer circumferential surface of the connecting pipe 92*c*.

The condensation water storage unit 400 includes a housing 402 provided in the form of partially surrounding around the circumference of the connecting pipe 92*c* at the outer side of the connecting pipe 92*c*, a water supply nozzle 430 provided at one side of the housing 402 to supply the condensation water to the inside the housing 402, and a drain nozzle 432 configured to drain the remaining water at the condensation water storage unit 400 after the drying process is completed.

The housing 402 forms a storage space 410, together with the outer circumferential surface of the connecting pipe 92*c*, to store the condensation water by sealing a partial section of the outer circumferential surface of the connecting pipe 92*c* in a longitudinal direction of the connecting pipe 92*c*. Since the condensation water which is flowed in to the storage space 410 through the water supply nozzle 430 moves to the upper portion of the storage space 410, the storage space 410 may be referred to as a condensation water passage.

The water supply nozzle 430 is provided at one side of the bottom portion of the housing 402, and the water supply pipe 99 (refer to FIG. 2) is connected to one end portion of the water supply nozzle 430 to supply the condensation water to the storage space 410 through the water supply nozzle 430.

Since the reason that the water supply nozzle 430 is provided at the bottom portion of the housing 402 is same as the reason, as previously explained, that the water supply nozzle 130 is provided at the bottom portion of the housing 102 according to the first embodiment of the present disclosure, the explanation will be omitted.

The draining nozzle 432 is provided at the bottom portion of the opposite side of the housing 402 to the side of the housing 402 having the water supply nozzle 430, and the condensation water draining hose 134, which connects the draining nozzle 432 to the duct connecting hose 93 so that the draining nozzle 432 may communicate with the duct connecting hose 92, is coupled to one end portion of the draining nozzle 432. Although not shown, the condensation water drain hose 134 may be directly connected to the rear wall of the tub 20 without being connected to the duct connecting hose 93.

Since the process of the remaining condensation water at the condensation water storage unit 400 discharged to the outside the cabinet 10 after the drying process is completed is same as the case of the first embodiment of the present disclosure explained previously, the explanation will be omitted.

A condensation water draining valve 435 which is configured to selectively drain the remaining water at the condensation water storage unit 400 may be provided at the draining nozzle 432. The condensation water draining valve 435, in a process of condensing the moisture in the air flowed in to the condenser duct 92, closes the draining nozzle 432, in order to prevent the condensation water, which is flowed in to the condensation water storage unit 400 through the water supply nozzle 430, from being drained through the draining nozzle 432; and if the process of condensing the moisture in the air flowed in to the drying duct 92 or the drying process is completed, allows the remaining water at the condensation water storage unit 400 to be discharged. As for such condensation water draining valve 435, both a mechanical and an electronic open/close value may be used.

A communicating hole 440 which is configured to communicate the storage space 410 with the air passage 420 is formed at the connecting pipe 92*c*. The communicating hole 440 passes through the connecting pipe 92*c* while being formed around the circumference of and in the circumferential direction of the connecting pipe 92*c* in a predetermined length.

In addition, the communicating hole 440 is disposed at an upper portion than the water supply nozzle 430 so that the condensation water flowed in to the storage space 410 through the water supply nozzle 430 may move to an upper portion of the storage space 410 and be flowed in to the air passage 420.

The condensation water flowed in to the storage space 410 through the water supply nozzle 430, after moving to an upper portion of the storage space 410, is flowed in to the air passage 420 through the communicating hole 440, and falls.

The condensation water, in a process of moving to an upper portion or in a process of being stored at the storage space 410, exchanges heat with the air moving through the air passage 420 in order to condense the moisture in the air, and condenses the moisture in the air by directly making contact with the air in a process of falling after being flowed in to the air passage 420.

The condenser duct 92 and the condensation water storage unit 400 may be integrally formed through a manufacturing method such as an injection molding, etc.

Although not illustrated, the condensation water storage unit 400, in order to increase the condensation efficiency, may include the dispersion member 150 so that the condensation water flowed in through the air passage 420 may be dispersed and fall.

Figure 13:
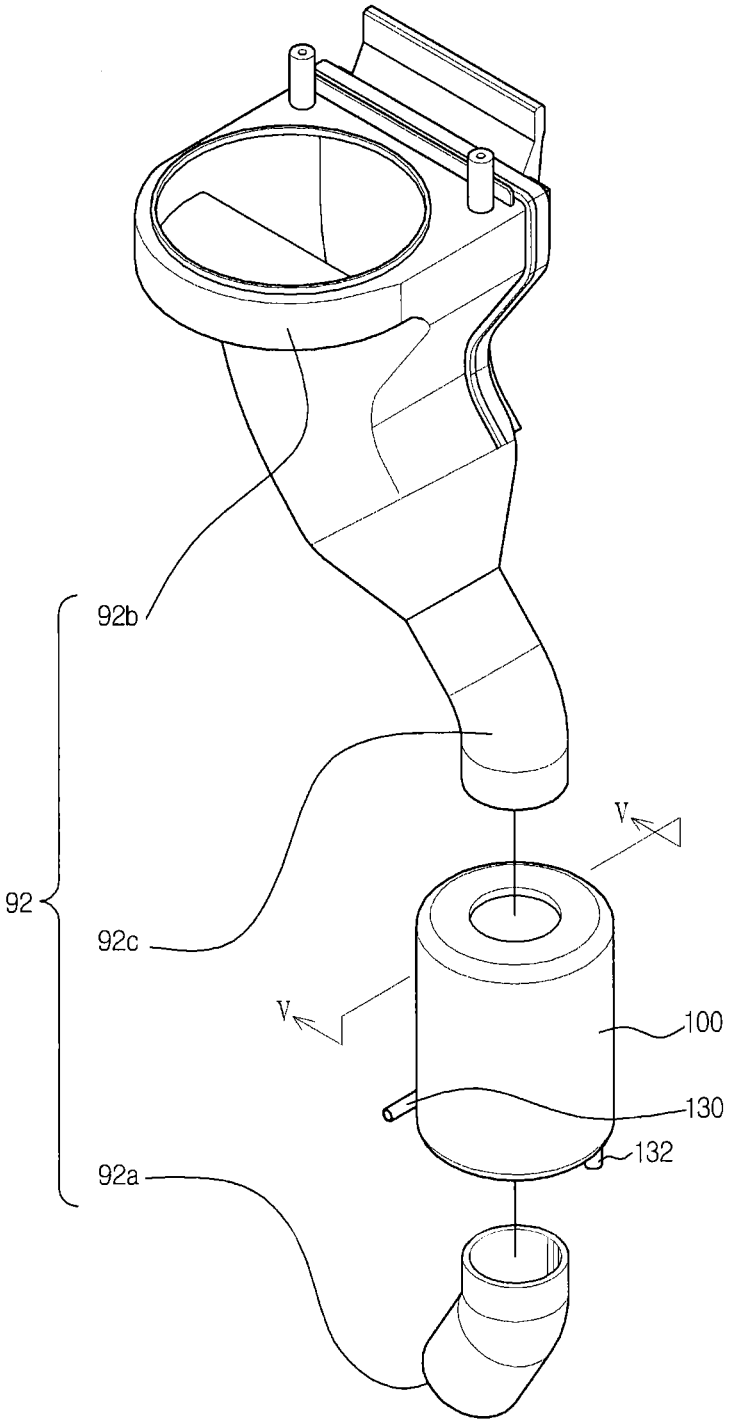
FIG. 13 is a view illustrating a structure of a condensation water storage unit that is formed separately from a condenser duct and coupled to the condenser duct.
Figure 14:
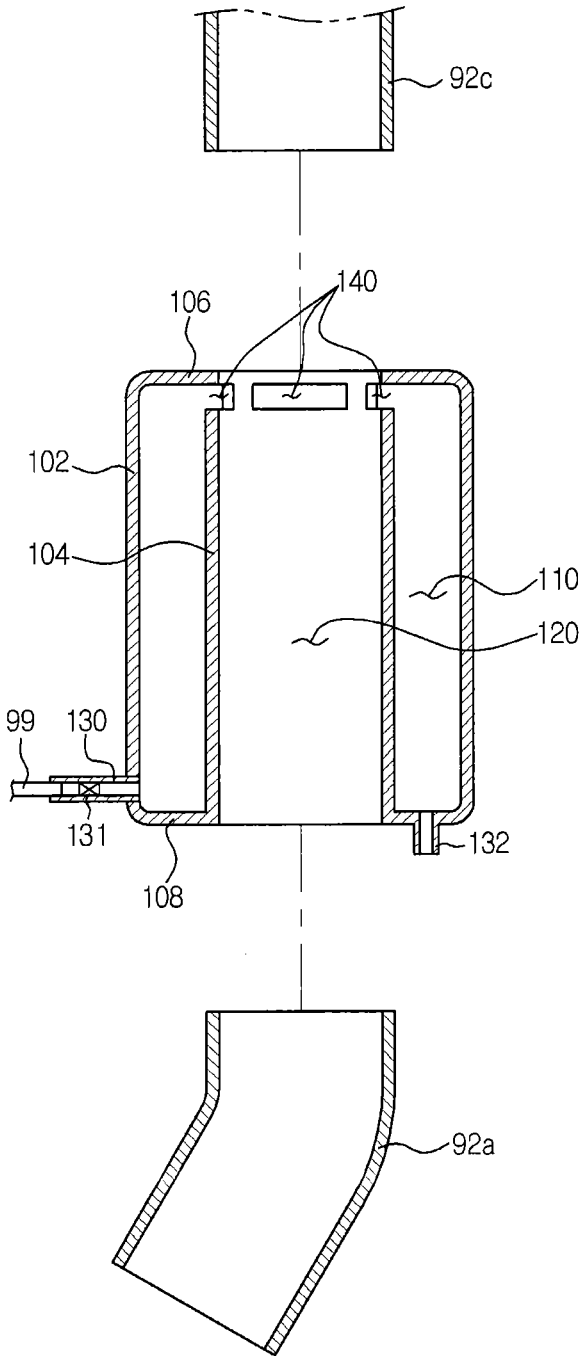
FIG. 14 is a cross-sectional view taken along line V-V line of FIG. 11.

FIG. 13 is a view illustrating a structure of a condensation water storage unit that is formed separately from a condenser duct and coupled to the condenser duct. FIG. 14 is a cross-sectional view taken along line V-V line of FIG. 11.

As illustrated on FIG. 13 and FIG. 14, the condensation water storage unit 100 may be formed separately from the condenser duct 92 and be coupled in the middle of the connecting pipe 92*c*.

In such case, the condensation water storage unit 100 includes the housing 102, a heat exchange unit 104 and the water supply nozzle 130. The heat exchange unit 104 is configured to divide the housing 102 into more than two spaces and is provided at the inner side of the housing 102 for condensation water and the air flowing in at the inside the condenser duct 92 to exchange heat to one another. The water supply nozzle 130 is provided at one side of the bottom portion of the housing 102.

An upper surface 106 and a bottom surface 108 of the housing 102 are configured to communicate with the connecting pipe 92*c*.

A heat exchange unit 104 is extended from the bottom surface 108 of the housing 102 in a longitudinal direction of the housing 102 by a predetermined length; and the housing 102 is divided into an inner side and an outer side by the heat exchange unit 104, and the air passage 120 in which air flows is formed at the inner side of the housing 102 while the condensation water passage 110 in which the condensation water is stored is formed at the outer side of the housing 102.

The communicating hole 140 is formed in the heat exchange unit 104 to communicate the condensation water passage 110 with the air passage 120.

The communicating hole 140 passes through the heat exchange unit 104 while being formed around the circumference of and in the circumferential direction of the heat exchange unit 104 in a predetermined length.

In addition, the communicating hole 140 is arranged at an upper portion than the water supply nozzle 130 so that the condensation water flowed in to the condensation water passage 110 through the water supply nozzle 130 may move to an upper portion of the condensation water passage 110 and be flowed in to the air passage 120.

The condensation water flowed in to the storage space 110 through the water supply nozzle 130, after moving to an upper portion of the storage space 110, is flowed in to the air passage 120 through the communicating hole 140, and falls.

The condensation water, in a process of moving to an upper portion or in a process of being stored at the storage space 110, exchanges heat with the air moving through the air passage 120 in order to condense the moisture in the air, and condenses the moisture in the air by directly making contact with the air in a process of falling after being flowed in to the air passage 120.

Figure 15:
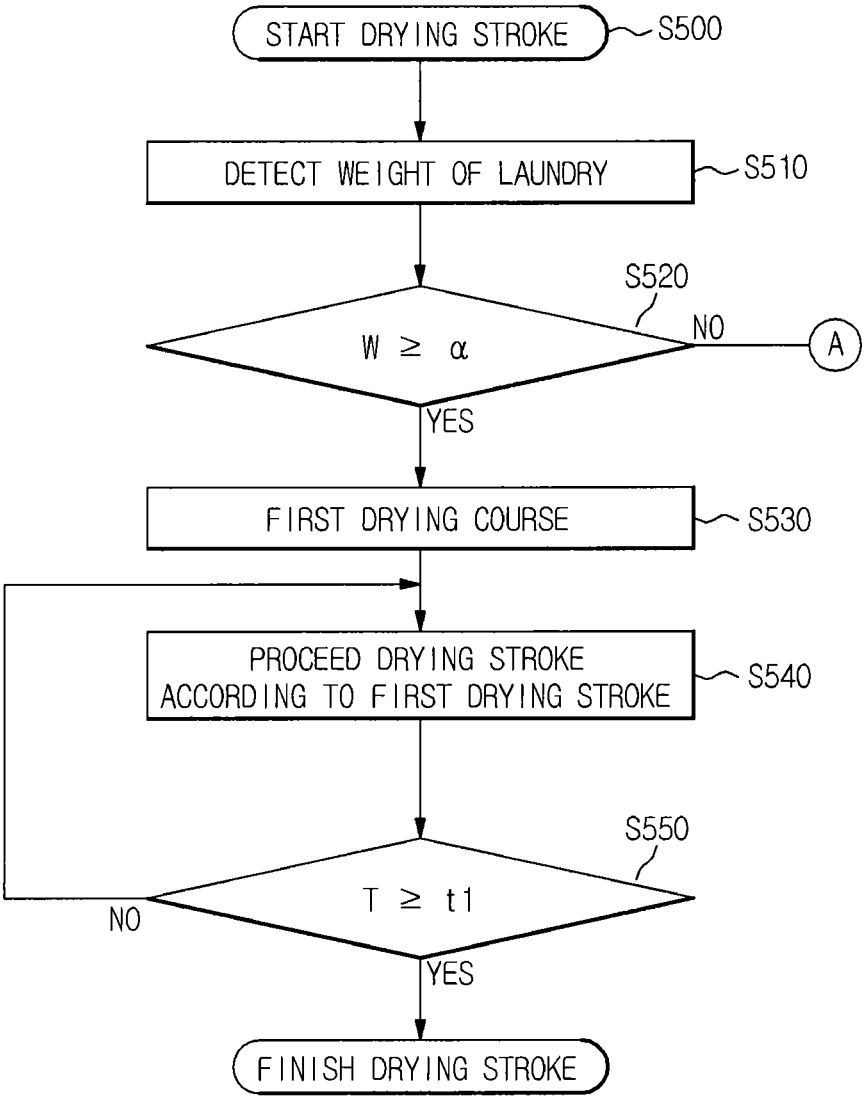
FIGS. 15 and 16 illustrate flow charts showing a control method of a drying stroke of a washing machine in accordance with an embodiment of the present disclosure.
Figure 16:
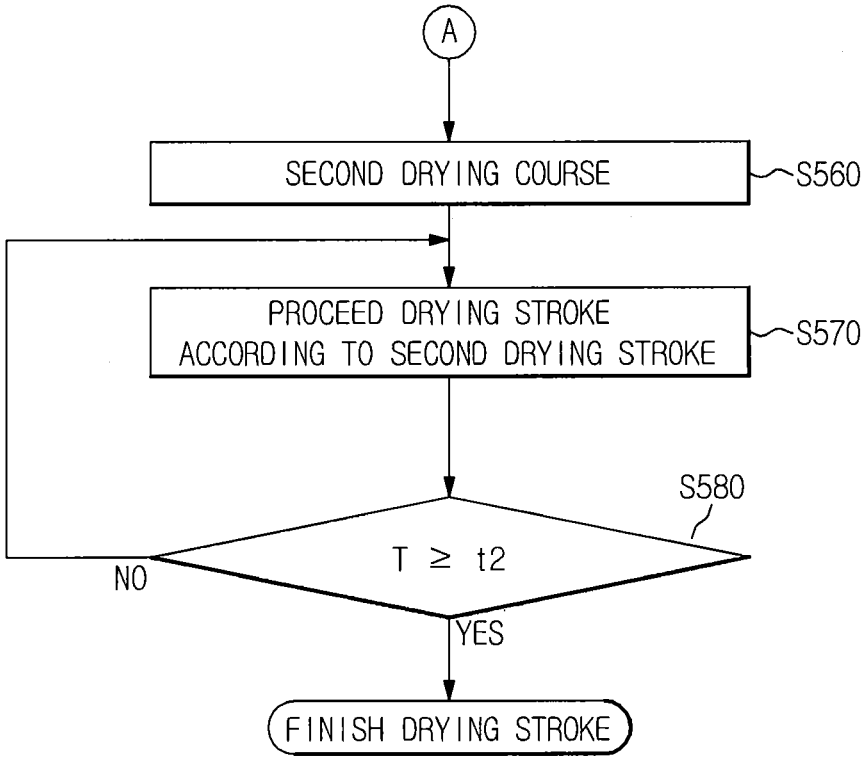

FIGS. 15 and 16 illustrate flow charts showing a control method of a drying stroke of a washing machine in accordance with an embodiment of the present disclosure.

Referring to FIGS. 15 and 16, when a washing stroke to remove dirt from laundry is completed, a drying stroke to remove the moisture included in the process of washing the laundry is started (S500). Here, proceeding with the drying stroke refers to repeating a condensing process of condensing the moisture in the air inside the condenser duct 92 and a heating process of heating air in the drying duct 94 while continuously circulating the air inside the tub 20 and the drying apparatus 90.

When the drying stroke is started, the weight of the laundry inside the drum 30 is detected (S510), and the weight W of the laundry is compared with a pre-entered value a (S520). If the weight of the laundry is less than the pre-entered value a, a first drying course (S530), which is configured to control the amount of the condensation water not to exceed the predetermined amount, is applied. A first drying stroke is proceeded (S540) by operating the draft fan 96 and the heater 98, which are included in the drying apparatus 90. The time T of duration of the first drying stroke is compared with a predetermined time t1 to determine whether the time T of the first drying stroke has elapses the predetermined time t1 (S550). If the predetermined time t1 is elapsed, the drying stroke is completed, and if the predetermined time t1 is not elapsed, the drying stroke is continued (S540).

If the weight W of the laundry is greater than or equal to the pre-entered value a, a second drying stroke (S560), which is configured to continuously supply the condensation water to the drying apparatus 90, is applied regardless of the predetermined amount, and a drying stroke is proceeded (S570) by operating the draft fan 96 and the heater 98 which are included at the drying apparatus 90. Then, the time T of drying stroke is compared with a predetermined time t2 to determine whether the time T of drying stroke elapsed the predetermined time t2 (S580). If the predetermined time t2 is elapsed, the drying stroke is completed, and if the predetermined time is not elapsed, the drying stroke is continued (S570).

In a process of proceeding with a drying by applying the drying stroke of operation S540 according to the first drying course or the drying stroke of operation S570 according to the second drying course, the time to supply the condensation water to the condensation water storage unit 100, may be controlled by considering the condensation efficiency and the drying time. That is, the condensation water is not supplied to the condensation water storage unit 100 simultaneously when the drying apparatus 90 is operated, but the condensation water is supplied to the condensation water storage unit 100 after a predetermined time is passed from the time the drying apparatus 90 is operated.

As described above, in order to absorb the moisture contained in the laundry, the temperature of the tub 20 is desired to be maintained between 70° C. and 120° C., and in order to increase the temperature of the air flowed in to the inside the tub 20 to between 70° C. and 120° C. in a short period of time at the beginning of an operation, the air needs to be heated by the heater 98 without having a cooling section. If the condensation water is supplied to the condensation water storage unit 100 too early or simultaneously at the time of the drying apparatus is operated, the condensation water may be stored in the condensation water storage unit 100 or may be spilled over the condensation water storage unit 100 and dropped to the condensation duct 92. Accordingly, the temperature of the air is dropped the chill of the condensation water that is stored in the condensation water storage unit 100 or dropped to the condenser duct 92, thereby the temperature may not be increased to the degree of the temperature needed for a drying in a short period time, that is, about between 70° C. and 120° C. Therefore, at the beginning of the drying apparatus 90, only the air is circulated without supplying the condensation water to the condensation water storage unit 100 such that the temperature of the air is be increased in a short period of time, and when the temperature is increased to the desired range of about 70° C. and 120° C., the condensation water is supplied to the condensation water storage unit 100 so that the moisture in the air is condensed.

In order to find out the temperature of the air flowed in to the inside the tub 20, a method to measure the inside temperature of the tub 20 or the drum 30, a method to estimate the temperature of the air flowed in to the inside the tub 20 through the elapsed time after the drying apparatus 90 is operated, and a method to directly measure the temperature of the air flowing at one end portion of the drying duct 94 by installing a temperature sensor, etc or a combined method of at least two of the above methods may also be used. Through such a method, the temperature of the air flowed in to the inside the tub 20 after the drying apparatus 90 is operated is measured. When the temperature of the air is increased to about 70° C. and 120° C., the condensation water is supplied to the condensation water storage unit 100, thereby able to increase the condensation efficiency or reduce the drying time.

The air heated by the heater 98 inside the drying duct 94 is flowed in to the inside the tub 20 at the temperature of about 70° C. and 120° C. The heated air absorbs the moisture dehydrated from the laundry inside the tub 20 is slightly cooled in a process of being introduced and flowed in the condensation duct 92 by the chill of the condensation water that is stored in the condensation water storage unit 100 or overflowing from the condensation water storage unit 100 and fallen to the condenser duct 92, and is flowed in to the inside the tub 20 after being heated by the heater 98 to the degree of about 70° C. and 120° C.

The drying stroke of operation S540 according to the first drying course includes various methods in controlling the amount of the condensation water, which is supplied to the drying apparatus 90, not to exceed a predetermined amount in the drying process.

As described above, the moisture in the air which passes through the drying duct 92 is condensed by the condensation water stored at the condensation water storage unit 110, or is condensed by directly making contact with the condensation water overflowing the condensation water storage unit 100; and in a case when the moisture in the air passing through the condenser duct 92 is determined to be sufficiently condensed by the condensation water stored at the condensation water storage unit 100, the condensation water may be controlled not to be supplied to the condensation water storage unit 100 for a predetermined period of time. That is, at first, the condensation water is supplied so that the condensation water may fall inside the condenser duct 92 after overflowing the condensation water storage unit 100, and in a case when the drying process is proceed to certain extent, the supply of the condensation water is then stopped so that the condensation may be performed only by using the condensation water stored at the condensation water storage unit 100; and if the condensation efficiency is determined to be decreased by the rising temperature of the condensation water stored at the condensation water storage unit 100, the condensation water is then supplied again so that the condensation process is performed through the condensation water overflowing from the condensation water storage unit 100, not only through the condensation water stored at the condensation water storage unit 100. At this time, a temperature sensor which is configured to measure the temperature of the condensation water stored at the condensation water storage unit 100 may be installed at the inner side or the outer side of the condensation water storage unit 100.

In addition, in a case when the first drying course (S530) is applied, in order to prevent the drying performance from falling, the amount of the condensation water supplied to the drying apparatus 90 may be controlled not to exceed a predetermined amount, and at the same time, the drying stroke having the condensation stroke and the heating stroke may be proceeded for more than the predetermined time.

A valve 131 which is configured to shut off/release the condensation water flowed in to the condensation water passage 110 from the water supply nozzle 130 may be provided at the water supply nozzle 130 of the drying apparatus 90. In a case when the first drying course of operation S530 is applied, the amount of the condensation water flowed in to the drying apparatus 90 may be controlled by controlling the valve with ON/OFF functions.

As such, in the process of proceeding with the drying stroke, the amount of the condensation water used for the drying stroke is controlled according to the weight of the laundry, thereby reducing the amount of the condensation water unnecessarily used.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a cabinet;

a tub installed inside the cabinet;

a drum rotatably installed inside the tub;

a condenser duct connected to the tub and configured to condense air discharged from the tub;

a drying duct connected to the condenser duct and configured to heat the air discharged from the condenser duct and supply the heated air to the inside of the tub; and a condensation water storage unit having a housing disposed surrounding the condenser duct to form a storage space between an outer circumferential surface of the condenser duct and an inner surface of the housing, wherein the condensation water storage unit further comprises:

a water supply nozzle disposed at the housing to introduce water from a lower portion of the storage space; and a communicating hole disposed at the outer circumferential surface of the condenser duct configured to communicate an inside of the condenser duct with the storage space, the communicating hole being positioned at an upper portion of the storage space such that water introduced from the water supply nozzle flows along the outer circumferential surface of the condenser duct and discharges to the inside of the condenser duct.

2. The washing machine of claim 1, wherein the condensation water storage unit further comprises a dispersion member that allows the water passed through the communicating hole to be dispersed inside the condenser duct and fall.

3. The washing machine of claim 2, wherein the dispersion member comprises:

a dispersion board which is provided at a lower portion of the communicating hole and extends from an inner circumferential surface of the condenser duct toward a central direction of the condenser duct, and a through hole which passes through the dispersion board to drop the condensation water positioned at an upper surface of the dispersion board.

4. The washing machine of claim 1, wherein the condensation water storage unit further comprises a drain nozzle provided at a lower portion of the housing to drain the condensation water stored in the storage space.

5. The washing machine of claim 4, wherein the condensation water storage unit further comprises a condensation water drain hose connected between the drain nozzle and the tub, and a condensation water drain valve configured to selectively open/close a passage between the drain nozzle and the tub.

6. A washing machine comprising:

a cabinet;

a tub installed inside the cabinet;

a condenser duct connected to the tub and configured to condense discharged from the tub;

a drying duct connected to the condenser duct and configured to heat the air discharged from the condenser duct;

a draft fan which is positioned between the condenser duct and the drying duct to supply the air heated through the drying duct; and a condensation water storage unit to cool the air moving inside the condenser duct, wherein the condensation water storage unit comprises:

a housing surrounding at least a portion of the condenser duct to provide a water storage space between an outer surface of the portion of the condenser duct and an inner surface of the housing;

a water inlet disposed at the housing to introduce water from a lower portion of the water storage space; and a communicating hole disposed at the outer surface of the condenser duct to communicate an inside of the condenser duct with the water storage space, the communication hole being positioned an upper portion of the water storage space such that the water introduced from the water inlet flows along the outer surface of the condenser duct, wherein the water discharged from the communication hole flows to the tub through the condenser duct while the air discharge from the tub flows in an opposite direction to a direction of the water flowing through the condenser duct.

7. The washing machine of claim 6, wherein the condensation water storage unit further comprises:

a dispersion member that allows the condensation water introduced through the communicating hole to be dispersed at the inner side passage and fall, wherein the dispersion member comprises:

a dispersion board which is extended from one end of the heat exchange unit toward a central direction of the housing, and a plurality of through holes which passes through the dispersion board to drop the condensation water positioned at an upper surface of the dispersion board.

* * * * *